US005370074A

United States Patent [19]

Knudsen et al.

[11] Patent Number: 5,370,074

[45] Date of Patent: Dec. 6, 1994

[54] METHOD AND DEVICE FOR TRACKING AN OBJECT

[75] Inventors: Tor Knudsen, Borre; Arne Løvik, St. Jørdal, both of Norway

[73] Assignees: Bentech Subsea A/S, Stjordal; Forsvarets Forskningsinstitutt, Kjeller, both of Norway

[21] Appl. No.: 955,868

[22] PCT Filed: Jun. 17, 1991

[86] PCT No.: PCT/NO91/00085

§ 371 Date: Dec. 14, 1992

§ 102(e) Date: Dec. 14, 1992

[87] PCT Pub. No.: WO92/00220

PCT Pub. Date: Jan. 9, 1992

[30] Foreign Application Priority Data

Jun. 28, 1990 [NO] Norway ..... 902883

[51] Int. Cl.[5] ..... B63G 8/00

[52] U.S. Cl. ..... 114/312; 114/313

[58] Field of Search ..... 114/312, 313; 405/185, 405/190, 191

[56] References Cited

U.S. PATENT DOCUMENTS

| | | | |
|---|---|---|---|
| 3,415,068 | 12/1968 | Casey, Jr. | 61/69 |
| 3,880,103 | 4/1975 | Talkington | 114/16 R |
| 4,010,619 | 3/1977 | Hightower et al. | 61/69 R |
| 4,157,229 | 6/1979 | Kumm | 114/312 |
| 4,185,580 | 1/1980 | Pujol et al. | 114/321 |
| 4,448,145 | 5/1984 | Hervieu | 114/312 |
| 4,462,330 | 7/1984 | Campbell et al. | 114/312 |

FOREIGN PATENT DOCUMENTS

| | | | |
|---|---|---|---|
| 2372076 | 6/1978 | France . | |
| 2491863 | 4/1982 | France | 114/312 |
| 60-189691 | 9/1985 | Japan . | |
| 441385 | 9/1985 | Sweden . | |

OTHER PUBLICATIONS

Popular Science, Jun. 1949, New Subs are Undersea Aircraft, Perry Githens, pp. 98–105.

Bell Labs Record, Sep. 1981, Scarab: Sea Sleuth, pp. 198–204.

*Primary Examiner*—Stephen P. Avila

*Attorney, Agent, or Firm*—Jeffrey H. Ingerman

[57] ABSTRACT

In a method and a device for tracking an object (2*a*), especially a subsea object, while utilizing a mother vessel (1) or an intermediate craft (101) equipped with sonars (3*a*) for the transmission and reflection of searching rays (3*b*, 3*n*) which on a display on the vessel (1) indicate one or more objects (2*a*) in the subsea search area, there is provided a searching unit (2) which is controlled from the vessel (1), and which comprises at least one transponder/responder (10, 13) or the like, for the transmission of signals corresponding to the searching rays (3*b*). The signal(s) is registered on the display on the mother vessel (1) and is used for guiding the searching unit (2) towards a selected object (2*a*) along the searching rays (3*b*, 3*n*) of the sonars.

28 Claims, 5 Drawing Sheets

METHOD AND DEVICE FOR TRACKING AN OBJECT

BACKGROUND OF THE INVENTION

The present invention relates to a method for tracking an object, especially a subsea object, there being used a mother vessel or an intermediate craft equipped with sonars for transmission and reflection of searching rays which on a display on the vessel indicate one or more objects in the subsea searching field.

The invention also relates to a device for this purpose.

The invention finds application for tracking any object, but will in the following be disclosed in connection with a special field of application, namely in connection with the removal of mines.

The removal of mines from a surface vessel includes a plurality of activities or problems. First of all the vessel has to detect the object for thereby enabling classification and thereafter destroying the object.

Today this is done by a combination of a hull mounted sonar for the detection/classification, ROV for visual classification/inspection and thereafter launching and detonation of the charge.

This process is time consuming because it requires a visual inspection from the ROV. After the ROV has positioned the charge, it must be brought to a safe distance before the charge is detonated. In addition, the charge must be large because it is a requirement to avoid a too close proximity between the mine and the costly ROV.

SUMMARY OF THE INVENTION

An object of the present invention is to present a concept for a novel system for searching for an object, especially a new system for inspection and destruction of mines, utilizing existing mine sonars and a light and inexpensive controlled weapon including a small charge. Through the TV camera in the weapon the system allows for visual classification of the mines before detonation, thereby involving a substantial reduction in time from the detection to the destruction of the target.

The object is achieved in a method which according to the invention is characterized in that there is used a searching unit which is controlled from the vessel or the craft, and which comprises at least one transponder/responder or similar for the transmission of signals corresponding to the searching ray, and that said signal(s) is registered on the display on the mother vessel and is utilized for controlling the searching unit towards the selected object along the searching rays of the sonar.

A favourable feature of the method is that signals from the transponder/responder are controlled in such a manner that the signal is received in the time interval coinciding with the displayed echo of the searching ray.

Preferably there are on the searching unit mounted sensors for measuring heading, horizontal plane angle and distance above bottom, and further there may on the mother vessel and/or the craft, possibly on the transducer of the mine searching sonar, be located a plurality of hydrophones, the measuring of the transponder/responder signal phase or the time delay at the hydrophones determining the position of the searching unit in the horizontal plane and/or the vertical plane.

The communication between the searching unit and the mother vessel and/or the craft takes place through an appropriate link, preferably a fibre optic cable arranged on a spool on the searching unit, the searching unit comprising TV equipment and light sources, as well as driving means, such that the operator on the mother vessel can control the unit as a remotely controlled unit and inspect the selected object via a TV screen.

Appropriately, the searching unit is utilized for removal of mines from a surface vessel or an intermediate craft, said unit comprising a charge, preferably a hollow charge or a directed charge which can be fired from the mother vessel, preferably after inspection via TV camera which may constitute a sight means, possibly through a signal from a proximity switch.

In addition, it is to be understood that the searching unit can be used as a training unit, comprising a gas cartridge and a gas inflatable balloon or a buoyancy chamber which can be activated by the operator.

A device for tracking for an object, especially a subsea object, the device being adapted to a mother vessel or an intermediate craft, equipped with sonars for the transmission and reflection of searching rays which on a display on the vessel indicate one or more objects in the subsea searching field, is, according to the invention, characterized in that the device comprises a searching unit which is controlled from the vessel or the craft, and which comprises at least one transponder/responder or similar for the transmission of signals corresponding to the searching rays, as well as means which process indications on the display in relation to a selected object, said relation being utilized for automatic or manual remote control of the searching unit towards the selected object along the searching ray of the sonar.

BRIEF DESCRIPTION OF THE DRAWINGS

Further features and advantages in the present invention will appear from the attached patent claims, as well as from the following description taken in connection with the attached drawings.

DESCRIPTION OF THE PREFERRED EMBODIMENTS

Figure 1A:
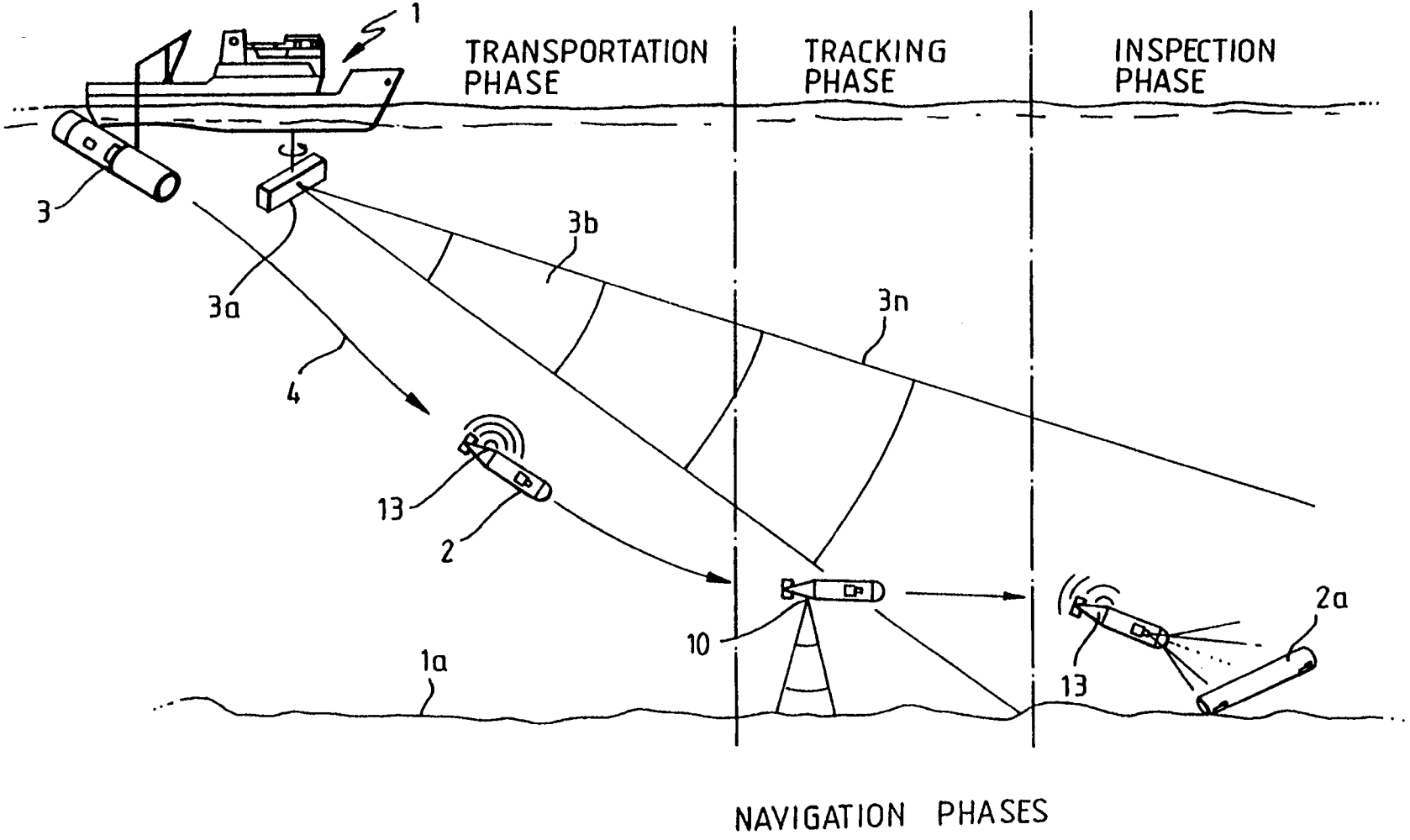
FIG. 1A illustrates schematically the principal of the present invention, especially in connection with tracking mines.

A system in which the present invention finds application is schematically illustrated in FIG. 1A. It comprises a system unit which is permanently installed on board a mine hunting vessel or a mother vessel 1, and a set of non-returnable weapons designated destructors 2 which are stored on board. The system unit comprises modules for launching a destructor, launcher 3, acoustic positioning (APS) and a central unit being connected to a mine hunting sonar 3A. The central unit will comprise operator console and a central processor which at any time calculates the heading and position, and which delivers maneuvering commands to the destructor 2 through a thin fibre cable 4. A sketch of the system in operation is illustrated in FIG. 1A, wherein also the various operational phases are included.

For the detection and the classification of objects, especially mines 2*a*, there is used a modern mine hunting sonar 3*a* which can comprise for example 100 receiver rays which together form a sector-shaped searching area in the horizontal plane. Each ray 3*n* is narrow in the horizontal plane, but relatively wide in the vertical plane, such that by a slanted incidence it will cover a large distance range along the bottom 1*a*.

If a weapon or a destructor 2 is to be guided downwards along the ray 3*n* hitting the mine 2*a*, it will have the correct heading. For this purpose there may be used for example the classification sonar, but due to a poor vertical resolution a simple device has to be installed for measuring the vertical position of the weapon.

It is to be understood that the weapon is to be light and inexpensive, for thereby being regarded as ammunition. Preferably, it may comprise a light warhead 18, for example a hollow charge.

Due to this light warhead 18 the weapon may be manufactured as a light and compact device having favourable hydrodynamic properties. A relatively small power could give the weapon a velocity of 8 knots.

The propulsion could be effected by two electrically driven propellers. At high velocity the control may take place by means of rudder, and at reduced and stationary maneuvering by means of thrusters 9 in the same manner as in an ROV, combined with internal displacement of the center of gravity.

The weapon can have a center of gravity and a center of buoyancy located so as to achieving a natural roll stabilisation.

Further, the weapon or the destructor 2 comprises sensors 10 for measuring the heading, the horizontal plane angle, depth and distance above bottom. In addition the destructor is equipped with a TV camera 11 covered by a spherical dome 11*a*, as well as lights 12 being used for the classification of the mine.

The distance to and the heading relating the weapon or the destructor 2 is measured by the mine hunting sonar 3*a* by equipping the destructor with an acoustic transponder 13 responding to the transmission of the mine hunting sonar 3*a*.

Figure 2A:
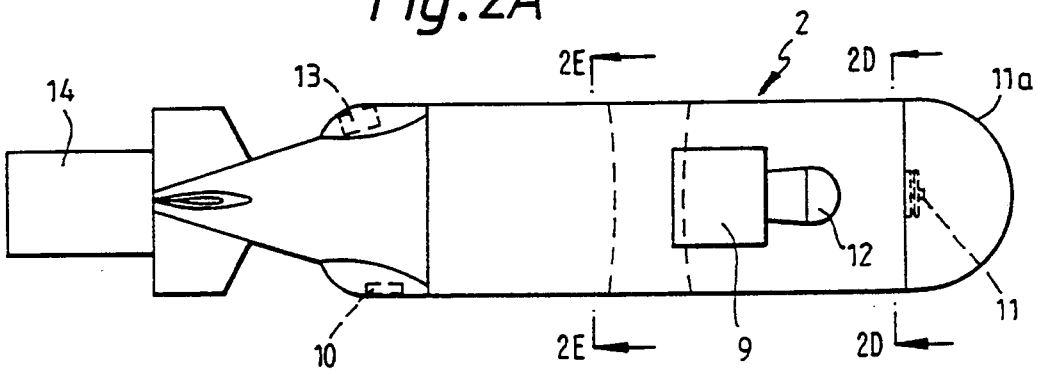
FIGS. 2A, 2B and 2C illustrate side view, longitudinal section and front view, respectively, of a weapon wherein the idea of the present invention has been implemented.
Figure 2B:
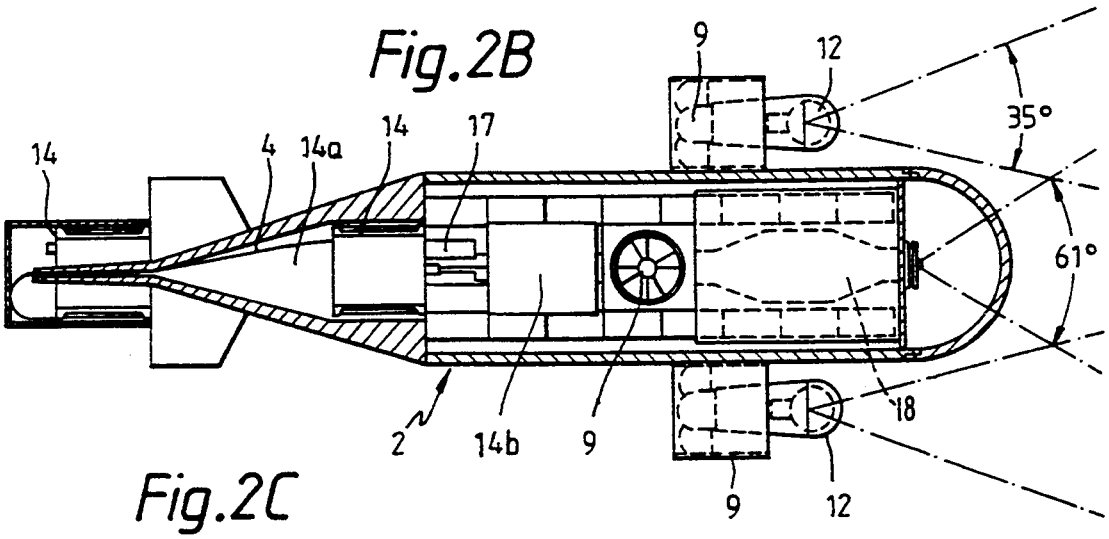
Figure 2C:
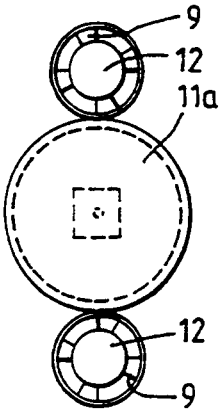
Figure 2D:
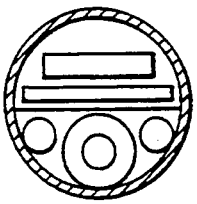
FIGS. 2D and 2E illustrate sections taken along the lines 2D—2D and 2E—2E, respectively, in FIG. 2A.
Figure 2E:
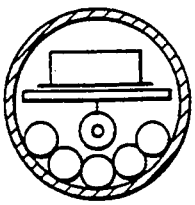

All communication between the destructor 2 and the mine hunting vessel 1 takes place through the fibre optic cable 4 which is spooled off from a spool 14 in the tail 14*a* of the destructor 2. The large data band width makes it possible for the main processing to be effected on the mine hunting vessel 1, such that the destructor 2 can comprise a minimum of electronics, see especially FIGS. 2D and 2E. An optical transceiver 14*b* converts any signals to optical signals, and controls the transmission and receipt thereof.

Typical measurements will include a length of approx. 100 cm, a diameter of approx. 20 cm and a weight less that 20 kg.

The destructor can be manufactured from a two component durable plastic moulded in one piece. In larger series, 250 units or more would give a rational production.

The control of the destructor 2 is realized in such a manner that when the destructor has reached the covering area of the classification sonar, the transponder signal from the destructor 2 will be indicated on the display, see FIG. 1 and FIGS. 4A–4C. This makes it possible to achieve a very accurate positioning in the horizontal plane, and the destructor 2 can be controlled accurately into that ray or the rays 3*n* receiving the echo from the mine.

Figure 3A:
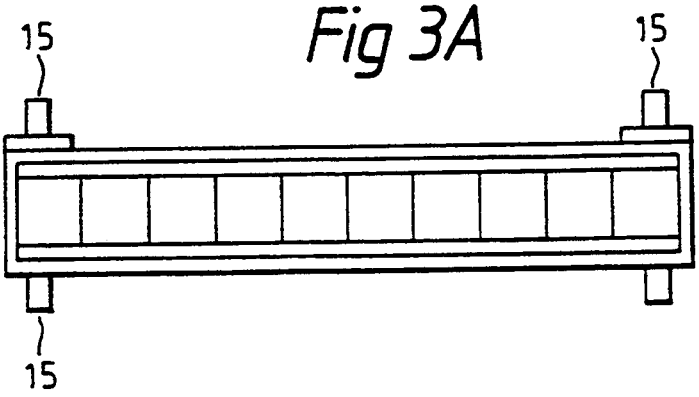
FIGS. 3A and 3B illustrate the hydrophone location on the transducer, seen from the front and from the side, respectively.
Figure 3B:
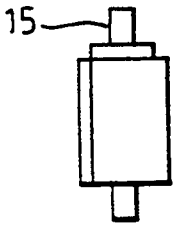
Figure 4A:
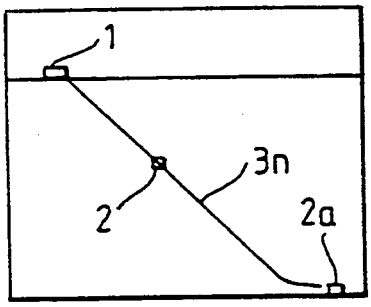
FIGS. 4A, 4B and 4C illustrate various screen pictures from the operator console.
Figure 4B:
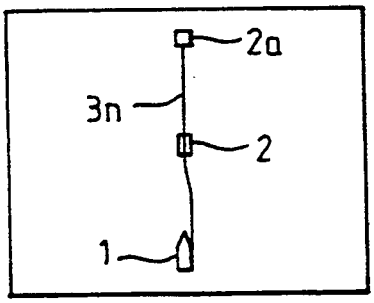
Figure 4C:
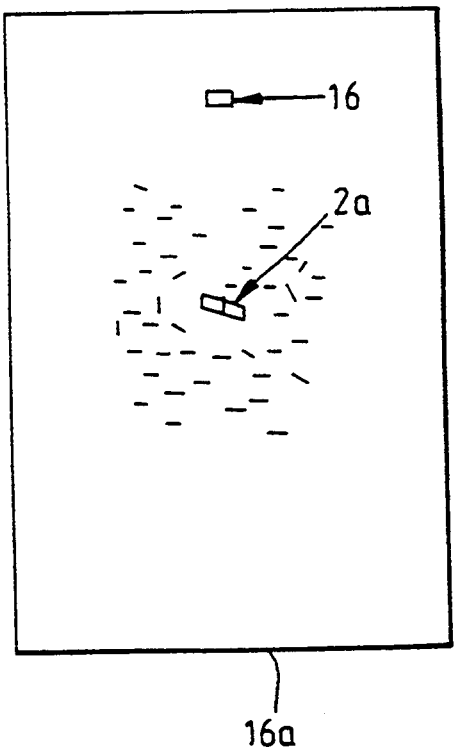

A separate acoustic positioning system, APS, 13 is utilized to guide the destructor into the covering area of the classification sonar after the launching, and for possibly controlling the position in the vertical plane when heading towards the mine. The hydrophones 15 in this system can be located on the transducer of the mine hunting sonar 3*a*, as illustrated in FIG. 3.

Said hydrophones could possibly be located on the mother vessel itself and/or on an intermediate craft, for example an ROV.

The destructor 2 can be equipped with a transponder/responder which transmits on the frequency of the mine hunting sonar 3*a* and with a selective code. The transmission is controlled in time, such that the transponder/responder signal is received in a time interval being inside the time window indicated by the mine hunting sonar. The echo from the mine or the target 2*a* and the transponder/responder signal is treated in the same manner in the classification sonar. The heading of the destructor 2 can therefore with high precision be compared with the heading towards the target 2*a*, as both appear on the standard display 16*a* of the mine classification sonar, see FIG. 4*c*.

In addition, a signal is transmitted which is received by the four hydrophones 15 which are mounted on the classification sonar 3*a*. The signals from the four hydrophones 15 are measured and utilized for determining the heading of the destructor in the vertical plane, and also in the horizontal plane before the destructor 2 has entered the sonar ray 3*n*.

In this phase the operator has only to concentrate on the heading. On the basis of the calculations made by the mine hunting sonar 3*a* regarding the distance to the target 2*a* and information about the water depth, the searching system will calculate a vertical guiding angle bringing the destructor 2 close to the bottom 1*a* some meters before arriving at the mine 2*a*. The altimeter 10 will then take over the vertical control and attend to the destructor 2 being moved along the bottom 1*a* until the mine 2 can be observed in the TV picture.

Only then will the operator visually control the destructor 2 as an ROV.

Alternatively, the destructor may be controlled automatically up to and including detonation.

It is important to realize that such an automatic control will not influence the cost of the destructor. All sonar detection, calculation of cruising angles and the control of the destructor 2, etc, takes place on the mine hunting vessel 1. The destructor 2 transmits sensor signals unprocessed up through the fibre optic cable 4 and receives control signals through the same cable.

The operator console comprises a classification monitor from the mine hunting sonar 3*a*, a TV monitor and a console for writing in depth and distance to the target as well as the transducer angle as appearing on the display 16*a* of the mine hunting sonar. In addition, there are provided joysticks for controlling the destructor 2.

By monitoring the acoustic transmission from the destructor 2, there is drawn up a cursor/marker 16 on the display 16*a* of the mine hunting sonar. By means of his joystick the operator shall maintain his cursor on the target 2*a* and the searching system measures the distance and the direction between the two cursors, for thereby by support from the level information and possibly depth information, controlling the destructor. Because both cursors are generated acoustically through this same sonar system, the destructor 2 will be guided onto the correct bearing, independent of varying current conditions, sound velocity profiles or thermal fronts.

The destructor is controlled so as to automatically follow the bottom 1*a* at a pre-programmed distance when approaching the target. When the distance is approx. 10 m, the velocity is reduced to approx. 0.2 m/s. The operator still controls the heading of the destructor 2 by for example maintaining his cursor on the target 2*a*. The height above the bottom 1*a* is controlled automatically by the searching system 10.

The destructor 2 can be controlled in such a manner that it reaches the level of the mine 2*a* above the bottom when being approx. 20 m therefrom. If the mine is a bottom mine the destructor will automatically flatten out to a height of approx. 2 m.

The destructor will maintain this level automatically. The speed is reduced to approx. 0.2 m/s and since the destructor all the time is controlled in the ray giving the mine echo, the mine will appear on the TV screen. The operator will thereafter guide the weapon as an ROV and inspect the target before aligning the destructor such that the charge is pointing towards the centre of the mine. When the destructor touches the mine, the operator will detonate the hollow charge.

In order to detonate the charge the following three safety requirements must be met:

1) A mechanical safety device is broken when the destructor is released in the launcher or is dropped over board. This enables:
2) A pressure detector can arm the charge after it has entered the water.
3) The charge can then be detonated by the operator through a special code which is transmitted through the fibre optic cable.

The charge can automatically be detonated a given time after having entered the water. This is to prevent live charges from being left over in case of a fault. Alternatively, the charge can be detonated through a special acoustic signal, for example a hand grenade which is discharged from the mine vessel. The destructor can be returned by having a pressure sensor 17 securing the charge when appearing on the surface.

The destructor is light, approx. 20 kg, and is therefore easily launched. By means of the hydrophones 15 which are located on the mine hunting sonar 3*a*, it is possible to follow the destructor 2 from the launching and thereby guide it into the covering area of the sonar. The launching can take place by having a simple arm lifting the destructor over the ship side and down into the water.

The object of the present searching system is to destroy the target in the shortest possible time after it has been classified as a mine or a possible mine. The searching system will therefore always have a destructor ready in the launcher 3 which is driven into position when the classification of the target is commenced. A time schedule can then be set up, wherein it is assumed that the target is at a distance of 300 m, and that the destructor can be driven towards the target with an effective speed of 2 m/s.

For the last 10 meters the destructor is driven at a reduced speed towards the target, for thereby detecting the latter visually through the TV camera. This is not to be used for searching since the acoustic system caters for the destructor to have the correct direction towards the target.

The time consumption for verification and destruction of a target which is at a distance of approx. 300 m, is assumed to be between 3 and 5 minutes.

A corresponding operation by using an ROV could be calculated to have a time consumption between 30 and 50 minutes.

Figure 2F:
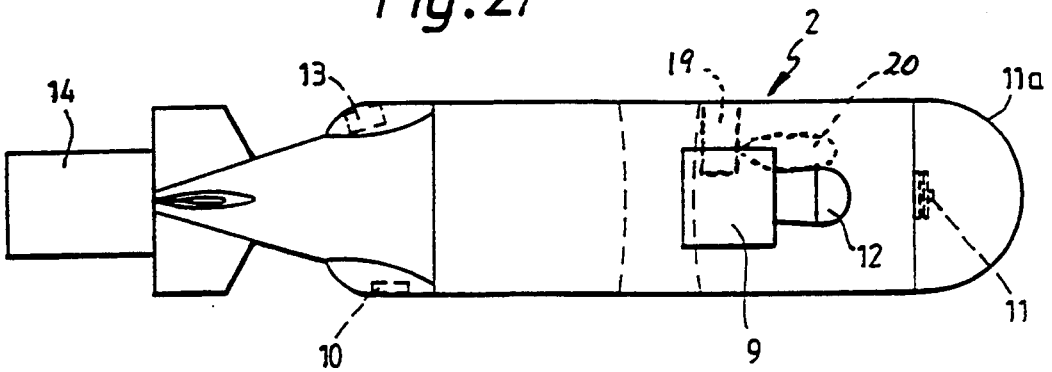
FIGS. 2F and 2G illustrate side view and longitudinal views, respectively, similar to FIGS. 2A and 2B, of an alternative embodiment of the invention.
Figure 2G:
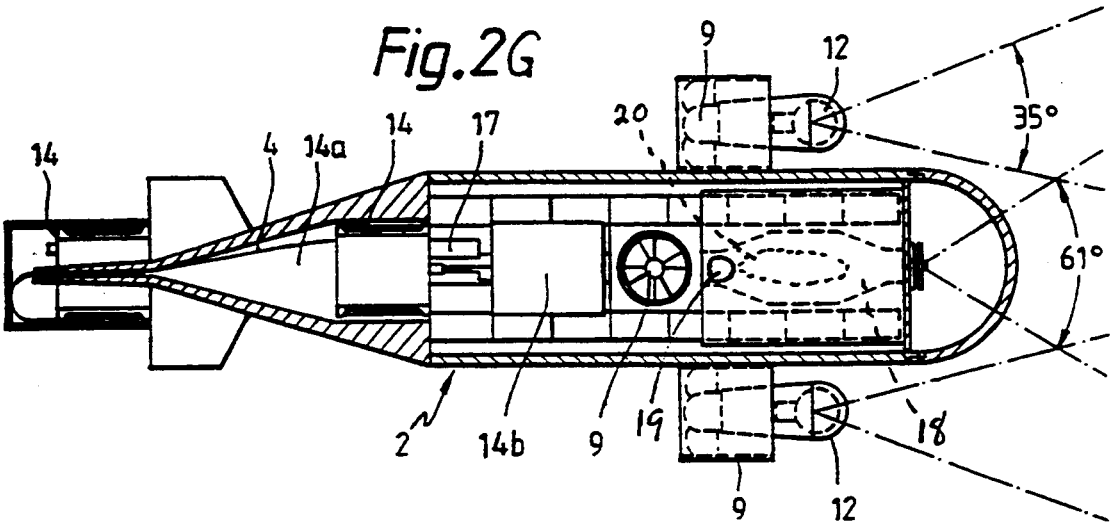

If the present invention is applied in connection with a training system, warhead 18 of the destructor will instead of including the charge include for example, as seen in FIGS. 2F and 2G, a balloon or buoyancy chamber 19 which is inflated by a gas cartridge 20 after training is finished, possibly as a result of activation by the operator. The destructor will then float to the surface, whereafter a flashing light will be activated. Thereafter, the destructor will be picked up either from a small boat or the mine hunting vessel.

Before the training destructor can be used once more, the following preparation must take place:

1) A new spool of fibre optic cable must be mounted.
2) A new balloon and a gas cartridge must be mounted.
3) Replace, possibly recharge the battery pack.

The training destructor is manufactured for enduring several operations. It will therefore have a different structure than the war destructor which shall only operate for 10–30 minutes.

In connection with FIG. 1A both sonar and launcher are arranged in connection with the mother vessel 1 itself.

Figure 1B:
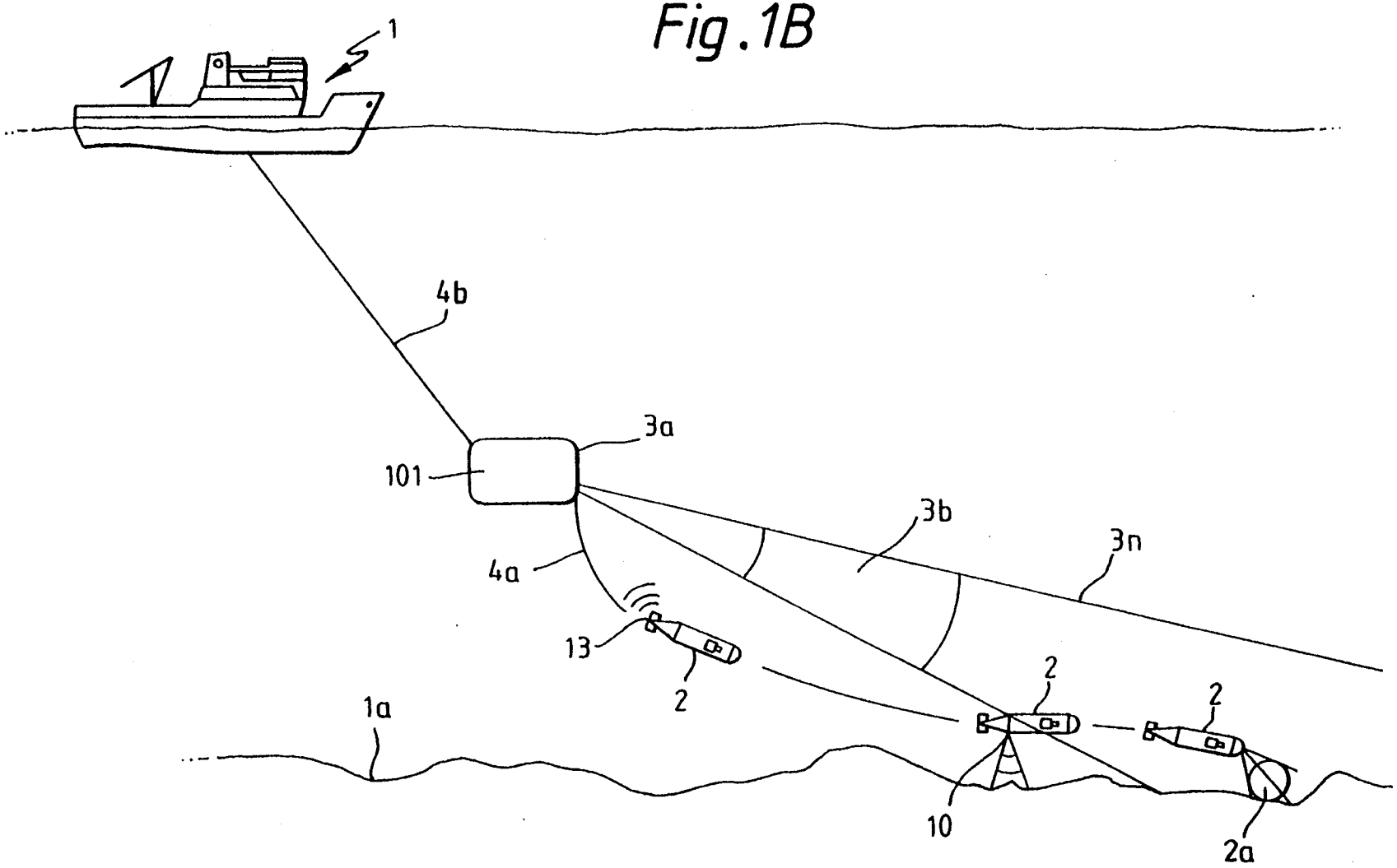
FIG. 1B illustrates schematically the principal of the present invention utilized in connection with an intermediate craft, for example an ROV.

FIG. 1B there is illustrated a system according to the present invention, wherein there is also used an intermediate auxiliary vessel 101 or a craft, for example an ROV, a towed craft or similar. This ROV or craft can in turn be equipped with its own launcher and own hydrophones, but is still connected to the mother vessel 1 for being controlled therefrom, for example by means of a link, comprising a first fibre cable 4*a* between the destructor 2 and the vessel 101, and a second possibly reinforced fibre cable 4*b* between the craft 101 and the mother vessel 1.

In a variant of a submerged auxiliary vessel, for example in form of a towed craft or ROV, this may carry its own launcher and own hydrophones, but also here be controlled from the surface mother vessel.

We claim:

1. A method for tracking and neutralizing an object, especially a subsea object, there being used a mother vessel or an intermediate craft equipped with sonars for transmission and reflection of searching rays which on a display on the vessel indicate one or more objects in the subsea searching field, said method comprising the steps of:

using a searching unit which is controlled from the vessel or the craft, and which comprises at least one transponder/responder for the transmission of signals which are designed so as to be distinguished from other echoes on the display, but still corresponding to the searching ray;

registering said signals on the display on the mother vessel; and utilizing said signals for controlling the searching unit towards said object along the searching rays of the sonar.

2. The method of claim 1, further comprising controlling signals from the transponder/responder such that the signal is received in the time interval coinciding with a displayed echo of the searching ray.

3. The method of claim 1 or 2, further comprising mounting on the searching unit sensors for measuring at least one of heading, horizontal plane angle, distance above bottom and depth.

4. The method of claim 1 or 2, further comprising arranging on one of (a) the mother vessel, (b) the intermediate auxiliary craft, and (c) the transducer of the mine hunting sonar, a plurality of hydrophones; and measuring one of the transponder/responder signal phase and the time delay at the hydrophone for determining the position of the searching unit in at least one of the horizontal plane and the vertical plane.

5. The method of claim 1 or 2, further comprising conducting communication between the searching unit and at least one of the mother vessel and the intermediate craft through an appropriate link, the searching unit comprising TV equipment and light sources, as well as driving means, such that the operator on the mother vessel can control the unit as a remotely controlled unit and inspect the selected object via TV screen.

6. The method of claim 1 or 2, wherein the searching unit is used for mine destruction from at least one of a surface vessel and an intermediate craft, said method comprising providing the unit with a warhead.

7. The method of claim 6, wherein the searching unit is used as a training unit, said step of providing a warhead comprising providing in said warhead one of (a) a gas cartridge and a gas inflatable balloon, and (b) buoyancy chambers, which can be activated by the operator.

8. Apparatus for tracking and neutralizing an object, especially a subsea object, said apparatus being adapted to a mother vessel or an intermediate craft equipped with sonars for transmission and reflection of searching rays which on a display on the vessel indicate one or more objects in the subsea searching field, said apparatus comprising a searching unit which is controlled from one of the vessel and the craft, and which comprises:

at least one transponder/responder for the transmission of signals which are designed so as to be distinguished from other echoes on the display, but still corresponding to the searching rays; and means for processing indications on the display in relation to a selected object, said relation being utilized for remote control of the searching unit towards the selected object along the searching ray of the sonar.

9. The apparatus of claim 8, wherein the transponder/responder comprises a dynamically controlled time delay means for positioning signals from the transponder/responder in a time interval coinciding with the displayed range sector of an echo of the searching ray.

10. The apparatus of claim 8 or 9, wherein the searching unit comprises sensors for measuring at least one of heading, horizontal plane angle, distance above bottom and depth.

11. The apparatus of claim 8 or 9, wherein on one of (a) the mother vessel, (b) the craft, and (c) the transducer of the mine hunting sonar, there are appropriately located a plurality of hydrophones, said apparatus further comprising means for measuring one of the phase of the transponder/responder signal and the time delay at the hydrophones for determining the position of the searching unit in at least one of the horizontal plane and the vertical plane.

12. The apparatus of claim 8 or 9, further comprising a link for communication between the searching unit and at least one of the mother vessel and the craft; wherein:

the searching unit comprises TV equipment and light sources, as well as driving means, such that an operator on the mother vessel can control the unit as a remotely controlled unit and inspect the selected object via TV screen.

13. The apparatus of claim 8 or 9, wherein the searching unit is adapted for mine destruction from at least one of a surface vessel and an intermediate craft, said unit comprising a warhead.

14. The apparatus of claim 13, wherein the searching unit is adapted as a training unit, said warhead comprising one of (a) a gas cartridge and a gas inflatable balloon, and (b) a buoyancy chamber, which can be activated by the operator.

15. The apparatus of claim 13 wherein said warhead comprises a hollow charge.

16. The apparatus of claim 13 wherein the warhead comprises a directed charge which is detonated from the mother vessel.

17. The apparatus of claim 16 further comprising a TV camera for inspecting the object before detonating said directed charge.

18. The apparatus of claim 17 wherein said TV camera is used as a sight device for maneuvering the unit into optimum position.

19. The apparatus of claim 18 further comprising a proximity switch for providing a signal for maneuvering the unit into optimum position.

20. The apparatus of claim 12 wherein said link for communication comprises a fibre optic cable.

21. The apparatus of claim 20 wherein fibre optic cable is provided on a spool in the searching unit.

22. The method of claim 5 wherein said step of conducting communication through an appropriate link comprises conducting communication through a fibre optic cable.

23. The method of claim 22 wherein said step of conducting communication through a fibre optic cable comprises arranging a fibre optic cable on a spool in the searching unit.

24. The method of claim 6 wherein the step of providing the unit with a warhead comprises providing a hollow charge in said warhead.

25. The method of claim 6 wherein the step of providing the unit with a warhead comprises providing a directed charge in said warhead, and said method further comprising detonating said directed charge from the mother vessel.

26. The method of claim 25 further comprising inspecting the object with a TV camera before detonating said directed charge.

27. The method of claim 26 further comprising using said TV camera as a sight device for maneuvering the unit into optimum position.

28. The method of claim 27 further comprising using a signal from a proximity switch for maneuvering the unit into optimum position.

* * * * *